US012806501B2

(12) United States Patent
McLachlin

(10) Patent No.: US 12,806,501 B2
(45) Date of Patent: Nov. 24, 2026

(54) KNEE POSITION GUIDE FOR USE AS A GOLF TRAINING AID

(71) Applicant: ShortGameChef, LLC, Scottsdale, AZ (US)

(72) Inventor: Parker McLachlin, Scottsdale, AZ (US)

(73) Assignee: ShortGameChef, LLC, Scottsdale, AZ (US)

( * ) Notice: Subject to any disclaimer, the term of this patent is extended or adjusted under 35 U.S.C. 154(b) by 171 days.

(21) Appl. No.: 18/816,162

(22) Filed: Aug. 27, 2024

(65) Prior Publication Data

US 2025/0073556 A1 Mar. 6, 2025

Related U.S. Application Data

(60) Provisional application No. 63/536,120, filed on Sep. 1, 2023.

(51) Int. Cl.
*A63B 69/36* (2006.01)

(52) U.S. Cl.
CPC ..... *A63B 69/3621* (2020.08); *A63B 69/3667* (2013.01); *A63B 2214/00* (2020.08)

(58) Field of Classification Search
CPC ..... A63B 69/3621; A63B 69/3667; A63B 2214/00
USPC ..... 473/266
See application file for complete search history.

(56) References Cited

U.S. PATENT DOCUMENTS

| | | | | |
|---|---|---|---|---|
| 4,116,447 | A | 9/1978 | Becker | |
| 4,659,084 | A * | 4/1987 | Vuick | A63B 69/3608 473/271 |
| 5,303,926 | A | 4/1994 | Owens et al. | |
| 5,474,299 | A | 12/1995 | Romano | |
| 6,312,345 | B1 | 11/2001 | Pelz | |
| 6,332,845 | B1 * | 12/2001 | Priestley | A63B 69/0057 473/409 |
| 6,988,957 | B2 | 1/2006 | Bender | |
| 7,150,683 | B2 | 12/2006 | Bender | |
| 7,238,117 | B1 | 7/2007 | Doss | |
| 7,566,278 | B2 | 7/2009 | Jackson | |
| 7,758,443 | B1 | 7/2010 | Ford | |
| 7,980,958 | B1 | 7/2011 | Ford | |

(Continued)

FOREIGN PATENT DOCUMENTS

| | | | |
|---|---|---|---|
| DE | 102011110150 | B4 | 5/2016 |
| WO | 2007009052 | A2 | 1/2007 |

*Primary Examiner* — Kristy A Haupt

(74) *Attorney, Agent, or Firm* — Carlson, Gaskey & Olds, P.C.

(57) ABSTRACT

This disclosure relates to a knee position guide configured for use as a golf training aid and corresponding methods. The knee position guide of this disclosure is especially useful when practicing various aspects of the short game, including hitting relatively short golf shots using a wedge. The knee position guide provides feedback to the user (i.e., the golfer) regarding their knee position, and is intended to assist the user in preventing their knees from buckling toward the golf ball during a golf swing. When the user focuses on preventing their knees from buckling, the user's body naturally becomes positioned and aligned such that the user is more likely to make solid and consistent impact with the golf ball, which in turn assists the user with achieving a desirable golf shot.

14 Claims, 7 Drawing Sheets

(56) References Cited

U.S. PATENT DOCUMENTS

| | | | | |
|---|---|---|---|---|
| 11,167,195 | B2 * | 11/2021 | Bridgewater ..... | A63B 69/3676 |
| 2006/0121999 | A1 | 6/2006 | Bender | |
| 2009/0075746 | A1 * | 3/2009 | Larsen ..... | A63B 69/3614 473/257 |
| 2010/0279984 | A1 | 11/2010 | Hamelburg | |
| 2011/0045918 | A1 | 2/2011 | Park | |
| 2016/0096101 | A1 | 4/2016 | Holland et al. | |
| 2017/0282043 | A1 | 10/2017 | Medley | |

* cited by examiner

KNEE POSITION GUIDE FOR USE AS A GOLF TRAINING AID

RELATED APPLICATION(S)

This application claims the benefit of U.S. Provisional Application No. 63/536,120, filed Sep. 1, 2023, the entirety of which is herein incorporated by reference.

BACKGROUND

Golf is a sport in which a player (i.e., a golfer) uses various clubs to hit a golf ball into a series of holes on a course. Among other things, golfing requires selection of an appropriate golf club for the distance between the golf ball and the target area where the ball is to be hit, proper alignment, and a proper swing of the golf club. Various golf training aids have been introduced to help players improve their driving, putting, impact, golf swing speed, and the mental game of golf. Most golf training aids are designed to be used while practicing the game of golf.

SUMMARY

In some aspects, the techniques described herein relate to a knee position guide for use as a golf training aid, including: a toe slot; and a main section arranged above the toe slot, wherein the main section is configured to contact a knee of a user if the knee excessively buckles during a golf swing.

In some aspects, the techniques described herein relate to a knee position guide, wherein the knee position guide is configured such that when the knee position guide is in use a top edge of knee position guide extends a height within a range of 18 to 24 inches above a ground surface.

In some aspects, the techniques described herein relate to a knee position guide, wherein the main section extends from an uppermost edge of the knee position guide to the toe slot.

In some aspects, the techniques described herein relate to a knee position guide, wherein the main section includes a through-hole configured to serve as a handle.

In some aspects, the techniques described herein relate to a knee position guide, further including a first foot on a first side of the toe slot, and a second foot on a second side of the toe slot opposite the first side.

In some aspects, the techniques described herein relate to a knee position guide, further including a board lying substantially perpendicular to a remainder of the knee position guide and attached to the first and second feet.

In some aspects, the techniques described herein relate to a knee position guide, further including a bracket connected to one of the first and second feet and configured to support the knee position guide relative to a ground surface.

In some aspects, the techniques described herein relate to a knee position guide, wherein the bracket is removable.

In some aspects, the techniques described herein relate to a knee position guide, wherein the bracket includes an opening configured to receive a portion of an anchoring device.

In some aspects, the techniques described herein relate to a knee position guide, wherein the anchoring device is a golf tee.

In some aspects, the techniques described herein relate to a knee position guide, wherein the knee position guide is symmetrical about a centerline, wherein the centerline is a line extending in a direction parallel to a height of the knee position guide.

In some aspects, the techniques described herein relate to a knee position guide, wherein the knee position guide is integrally formed from a single piece of plexiglass.

In some aspects, the techniques described herein relate to a knee position guide, wherein a top edge of the knee position guide is angled so as to be substantially parallel to an anticipated lie angle of a shaft of a golf club.

In some aspects, the techniques described herein relate to a knee position guide, wherein the knee excessively buckles during a golf swing if the knee moves laterally by two or more inches during the golf swing.

In some aspects, the techniques described herein relate to a method, including: instructing a user to place a knee position guide between the user and a golf ball, wherein the knee position guide includes first and second feet, a toe slot, and a main section arranged above the first and second feet and the toe slot; instructing the user to place their toes at least partially into the toe slot; and instructing the user to take a golf swing such that, when a knee of the user excessively buckles during the golf swing, the knee contacts the main section.

In some aspects, the techniques described herein relate to a method, wherein, before the user initiates a golf swing, the knee position guide is spaced-apart laterally from the knee by two or more inches.

In some aspects, the techniques described herein relate to a method, including: providing feedback to a user that a knee of the user has excessively buckled during a golf swing when the knee contacts a knee position guide between the user and a golf ball.

In some aspects, the techniques described herein relate to a method, wherein the feedback is provided by contact between the knee and the knee position guide.

In some aspects, the techniques described herein relate to a method, wherein the knee position guide is configured such that when the knee position guide is in use a top edge of knee position guide extends a height within a range of 18 to 24 inches above a ground surface such that the knee position guide is able to contact a knee of the user if the knee excessively buckles during a golf swing and such that the knee position guide does not otherwise interfere with an ability of the user to perform a golf swing.

In some aspects, the techniques described herein relate to a method, wherein, before the user initiates a golf swing, the knee position guide is spaced-apart laterally from a knee of the user by two or more inches.

DETAILED DESCRIPTION

This disclosure relates to a knee position guide configured for use as a golf training aid and corresponding methods. In this regard, the knee position guide may be referred to as a training aid or a training aid system or simply a "system." The knee position guide of this disclosure is especially useful when practicing various aspects of the short game, including hitting relatively short golf shots using a wedge. The knee position guide provides feedback to the user (i.e., the golfer) regarding their knee position, and is intended to assist the user in preventing their knees from buckling toward the golf ball during a golf swing. When the user focuses on preventing their knees from buckling, the user's body naturally becomes positioned and aligned such that the user is more likely to make solid and consistent impact with the golf ball, which in turn assists the user with achieving a desirable golf shot.

Figure 1:
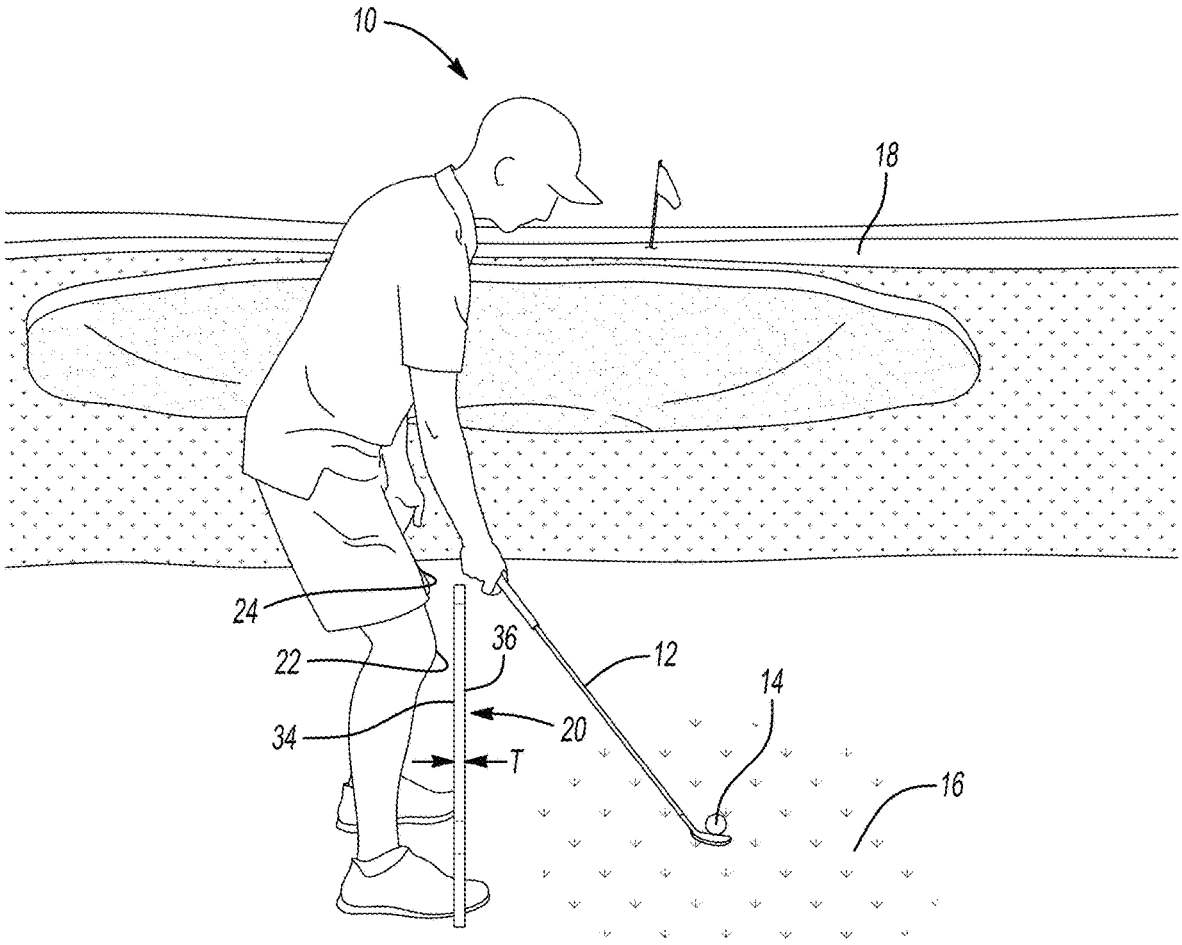
FIG. 1 is a down-the-line view of a golfer relative to a golf ball and an example knee position guide.

FIG. 1 is a down-the-line view of a user, or golfer, 10 partially gripping a golf club 12. The golfer 10 is aligned relative to a golf ball 14, which lies on a ground surface 16, and is readying to swing the golf club 12 to hit the golf ball 14 toward a target area, such as a green 18, in a forward direction (i.e., generally into the page relative to FIG. 1). The ground surface 16 may be grass or sand, as examples.

A typical golf swing includes a backswing in which the golfer 10 moves the golf club 12 rearwardly (i.e., generally out of the page relative to FIG. 1), a transition when the golfer 10 changes the direction of travel of the golf club 12 from rearward to forward near the end of the backswing, a downswing when the golfer 10 moves the golf club 12 forward toward the golf ball 14, impact when the golf club 12 strikes the golf ball 14, and a follow through where the golfer 10 swings the golf club 12 through the ball and to a finish position.

When attempting to hit certain types of golf shots, golfers of all levels often make improper or undesirable body movements that negatively influence their ability to hit desirable golf shots. Such undesirable movements are sometimes referred to as compensations. Often, a golfer incorrectly believes a particular compensation will assist the golfer in hitting a better golf shot, but ultimately that compensation leads to a poor golf swing and/or a poor golf shot. One such compensation that is a focus of this disclosure includes buckling of a golfer's knees when the golfer attempts to hit various short game shots. Exemplary short game shots include hitting flop shots, bunker shots, pitch shots, and chip shots. Such shots require touch and finesse, and are typically hit with a specialized golf club known as a wedge.

In this disclosure, knee buckling refers to one or both knees of the golfer flexing such that the knee moves too far toward the golf ball 14 (i.e., laterally to the right, relative to FIG. 1) during a golf swing. Golfers sometimes buckle their knees when hitting short game shots for various reasons. One reason includes attempting to lower their golf club 12 to ensure the golf club 12 will not hit a top part of the golf ball 14, resulting in a poor strike sometimes referred to as blading, in which the leading edge of the golf club 12 hits the golf ball 14 at its equator or higher, leading to a low lofted shot with excessive top spin. However, due to the excess buckling of the knees, golfers often create another problem known as chunking a golf shot, or hitting a fat golf shot, which is where the golf club 12 hits the ground surface 16 before hitting the golf ball 14 and leads to a poor golf shot where the golf ball 14 does not travel as far as intended. Thus, the compensation of buckling the knees, which is intended to prevent a bladed golf shot, causes another type of poor shot (i.e., a chunked/fat shot). Such a cycle can be exceedingly frustrating for a golfer, and lead to a mental condition known in golf as the "yips," which is an extreme state of nervousness causing the golfer to doubt their skills and abilities.

In FIG. 1, a knee position guide 20 is positioned between the knees 22, 24 of the golfer 10 and the golf ball 12. The knee position guide 20 is configured to provide feedback to the golfer 10 if the golfer's knees 22, 24 buckle excessively during a golf swing. In this disclosure, excessive knee buckling refers to excessive lateral movement (i.e., in the right-hand direction, relative to FIG. 1) of either or both of the knees 22, 24 during a golf swing. In a particular example, buckling of the knees 22, 24 is excessive when either knee flexes such that it moves laterally by 2 inches or more.

The golfer 10 is instructed regarding how to position the knee position guide 20 relative to their knees 22, 24 at set up (i.e., just before the golfer 10 takes a swing) by a golf instructor or an instructional guide, such as a video or written tutorial. If the golfer's knees 22, 24 buckle excessively, the golfer's knees 22, 24 will contact the knee position guide 20. This provides the golfer 10 with feedback that their knees 22, 24 have buckled excessively and that the golfer 10 should focus on preventing such knee buckling in future swings. By focusing on preventing excess knee buckling, the golfer 10 will naturally make a more biomechanically sound golf swing, leading to more consistent impact and better overall golf shots. In other words, focusing on preventing excess knee buckling naturally forces other parts of the golfer's body to move in a more biomechanically sound manner, at least from a golfing perspective and in particular from a perspective of hitting short game shots. In turn, the knee position guide 20 reduces the likelihood that the golfer 10 will hit a bladed or chunked shot, which in turn grows the golfer's confidence and reduces if not eliminates the yips. The knee position guide 20 is particularly useful when the golfer 10 is practicing short game shots, however the knee position guide 20 may be useful when the golfer 10 is practicing other shots such as full swing golf shots.

Figure 2:
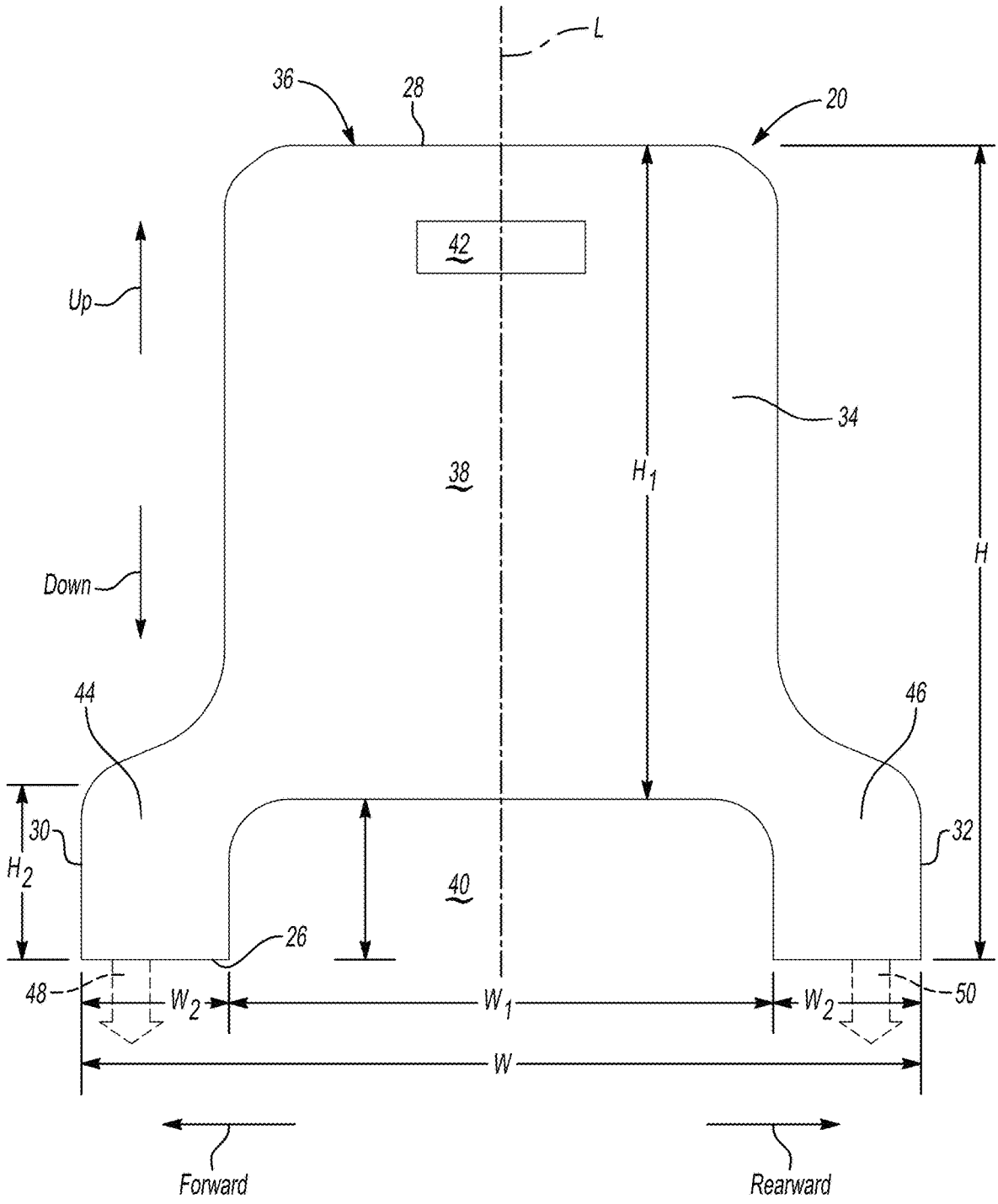
FIG. 2 is another view of the example knee position guide.

An example knee position guide 20 is shown in more detail in FIG. 2. FIG. 2 is a view of the knee position guide 20 from one standing to the left-hand side of the knee position guide 20 in FIG. 1. The knee position guide 20 exhibits an overall height H between a bottom edge 26 and a top edge 28, an overall width W extending between a forward edge 30 and a rearward edge 32, and a thickness T (FIG. 1) extending into the page in FIG. 2 between a first side 34 and a second side 36. As shown in FIG. 1, the first side 34 is facing the golfer 10, although the knee position guide 20 is symmetrical such that it can also be used when arranged such that the second side 36 faces the golfer 10. The knee position guide 20, in this example, is also symmetrical about a centerline C, which is a line extending in a direction parallel to the overall height H and perpendicular to the overall width W. Some directions are labeled in FIG. 2, such as up, down, forward, and rearward.

In an example, the overall height H is 22 inches, the overall width W is 21 inches, and the thickness T is 0.375 inches. In another example, the thickness T is 0.25 inches. While specific dimensions are mentioned, the size of the knee position guide 20 may vary. For instance, the overall height H may be within a range of 18 to 24 inches. The aforementioned size of the knee position guide 20, and in particular the overall height H, is beneficial because it ensures a user's knees will contact the knee position guide 20 if the user's knees excessively buckle without interfering the user's golf swing. In other words, the knee position guide 20 is high enough to contact the knees 22, 24 of the golfer 10 if they buckle excessively, but not so high that the golfer's hands or golf club 12 hit the knee position guide 20 during a golf swing.

The knee position guide 20 includes a main section 38 extending from the top edge 28 down to a toe slot 40 along a height H1. The height H1 is 18 inches in one example. The main section 38 is substantially rectangular and exhibits a width W1 of 14 inches in one example. The width W1 is slightly wider than the distance between the golfer's knees 22, 24 when set up to hit a short game shot.

Adjacent a top of the main section 38, the knee position guide 20 includes a through-hole opening 42 which serves as a handle. Specifically, a user can grasp the knee position guide 20 by placing their hand through the opening 42 and around the top edge 28. The opening 42 is not present in all examples. When present, other than the opening 42, the main section 38 is continuous and solid such that it will contact knees of users of various heights.

The knee position guide 20 further includes two feet 44, 46 which project downward from the main section 38 and outward from the main section 38, specifically with the foot 44 projecting forward from the main section 38 and the foot 46 projecting rearward. With reference to the foot 44, the foot 44 exhibits a width W2 of 3.5 inches, in one example. The foot 44 exhibits a height H2 of 6 inches, in one example. The foot 46 is configured in substantially the same manner.

Figure 7:
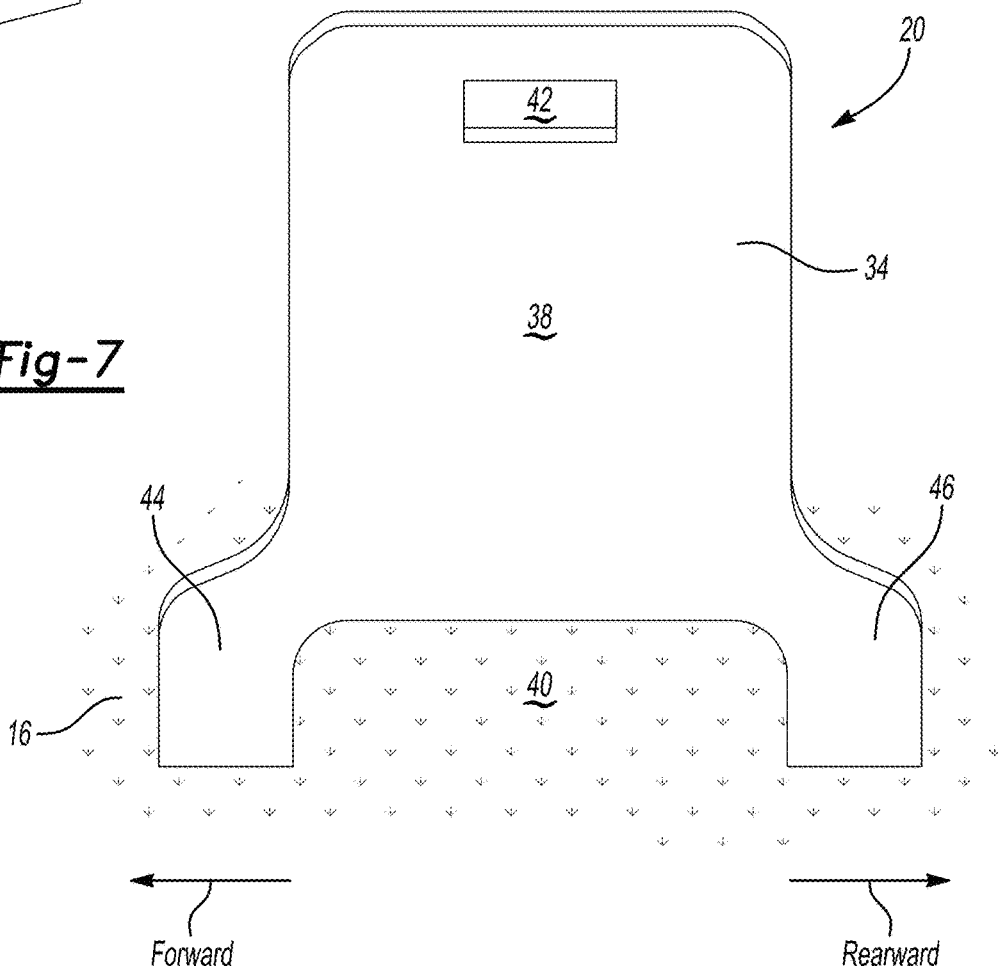
FIG. 7 is a view of the example knee position guide of FIG. 2, with the knee position guide supported relative to a ground surface.

The feet 44, 46 extend from the main section 38 to the bottom edge 26 of the knee position guide 20. The bottom edge 26 and, in turn, the bottom edge of the feet 44, 46 are configured to contact the ground surface 16, as shown in FIG. 7. In some embodiments, one or more stakes project downward from the feet 44, 46. Two example stakes 48, 50, one projecting from each foot 44, 46, are shown in dashed lines in FIG. 2 for reference. The stakes 48, 50 are essentially projections, which may be sharp, and are configured to project into the ground surface 16 to support the knee position guide 20 above the ground surface 16. To set up the knee position guide 20, a user presses the stakes 48, 50 into the ground surface 16 until the bottom edge 26 of the feet 44, 46 contact the ground surface 16. The user may use their hands or feet to press the stakes 48, 50 into the ground. In one example, the user presses the stakes 48, 50 into the ground by stepping on a top edge of the feet 44, 46.

Figure 3:
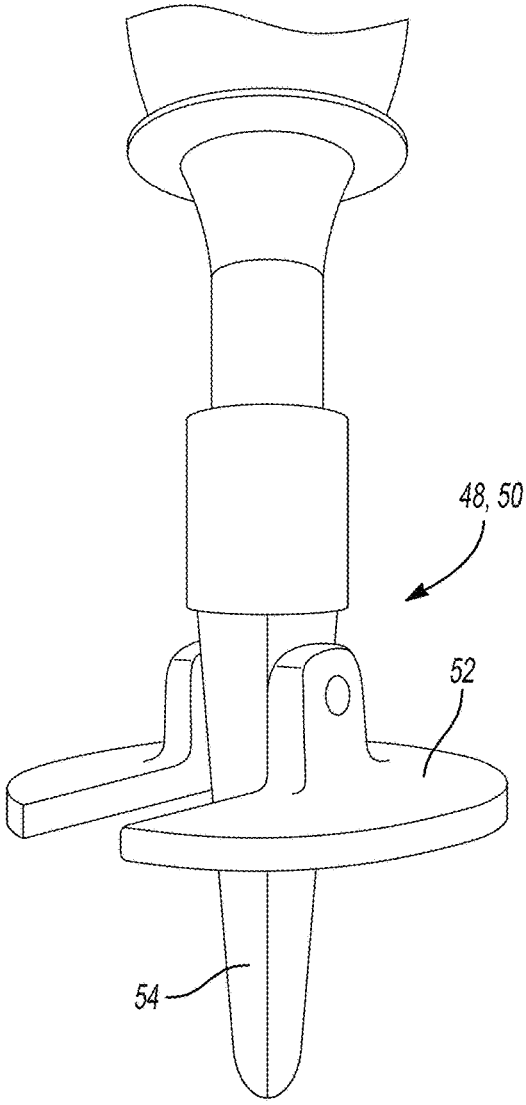
FIG. 3 is a view of an example stake.
Figure 4:
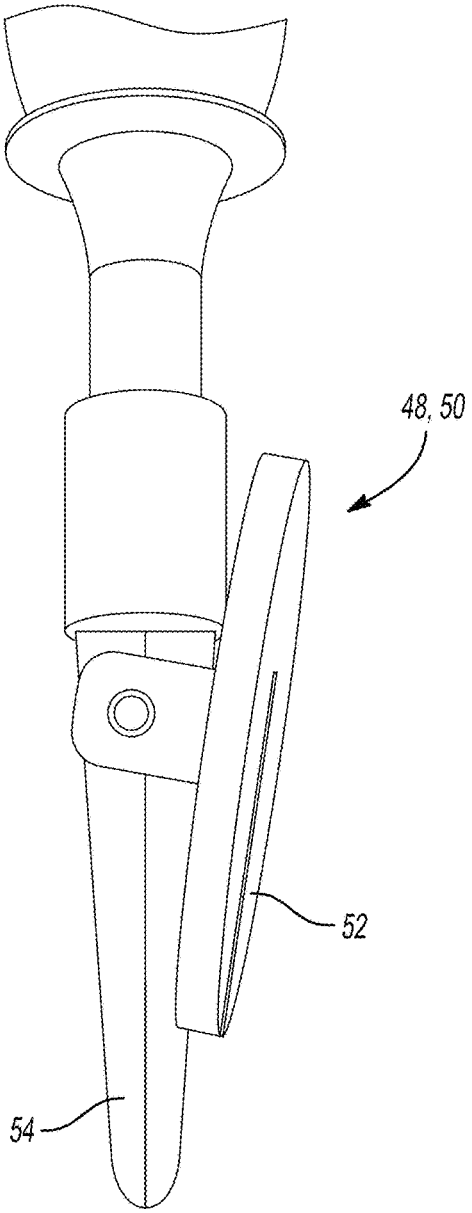
FIG. 4 is another view of the example stake.
Figure 5:
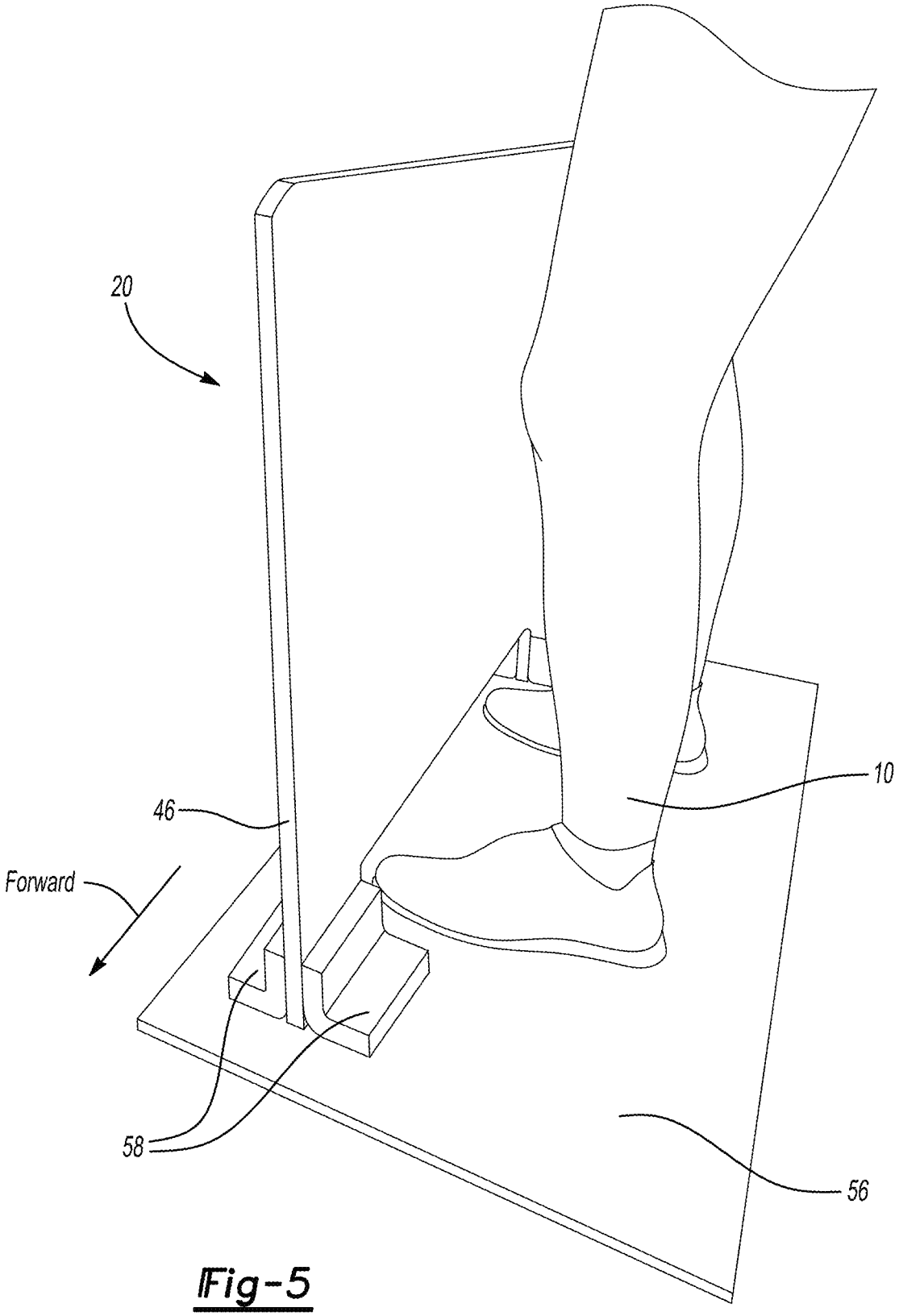
FIG. 5 is a view of another example knee position guide.
Figure 10:
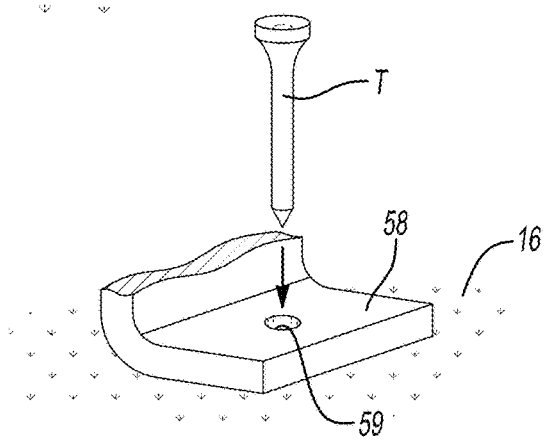
FIG. 10 is a view an example arrangement for supporting a bracket relative to a ground surface.

Example stakes 48, 50 are shown in FIGS. 3 and 4. The stakes of FIGS. 3 and 4 include a moveable portion 52 configured to swing relative to a spike 54. This disclosure extends to other types of stakes, however, including stakes without a moveable portion. While stakes are mentioned, the knee position guide 20 could be supported relative to the ground surface 16 using other techniques. One such technique includes the feet 44, 46 being attached to one or more flat, relatively planar boards 56 (FIG. 5) lying substantially parallel to the ground surface 16. In that example, one or more L-shaped brackets 58 may be used to connect the feet 44, 46 to the board 56. Alternatively, the knee position guide 20 could be supported on the ground surface by one or more L-shaped brackets, such as the brackets 58, which are not connected to a board 56. Further, an anchoring device, such as a golf tee T, could be provided through one or more holes 59 in the brackets 58 to support the knee position guide 20 relative to the ground surface 16, as generally shown in FIG. 10. In this example, the board 56 need not be present as the anchoring device (e.g., golf tee T) can interact directly with a ground surface 16. The ground surface 16 could be grass, dirt, sand, artificial grass (i.e., turf), etc. The brackets 58 can be detachable from the remainder of the knee position guide 20 or formed integrally with the remainder of the knee position guide 20. The anchoring device could be another sort of anchor device such as a tent stake, or another type of stake.

Figure 8:
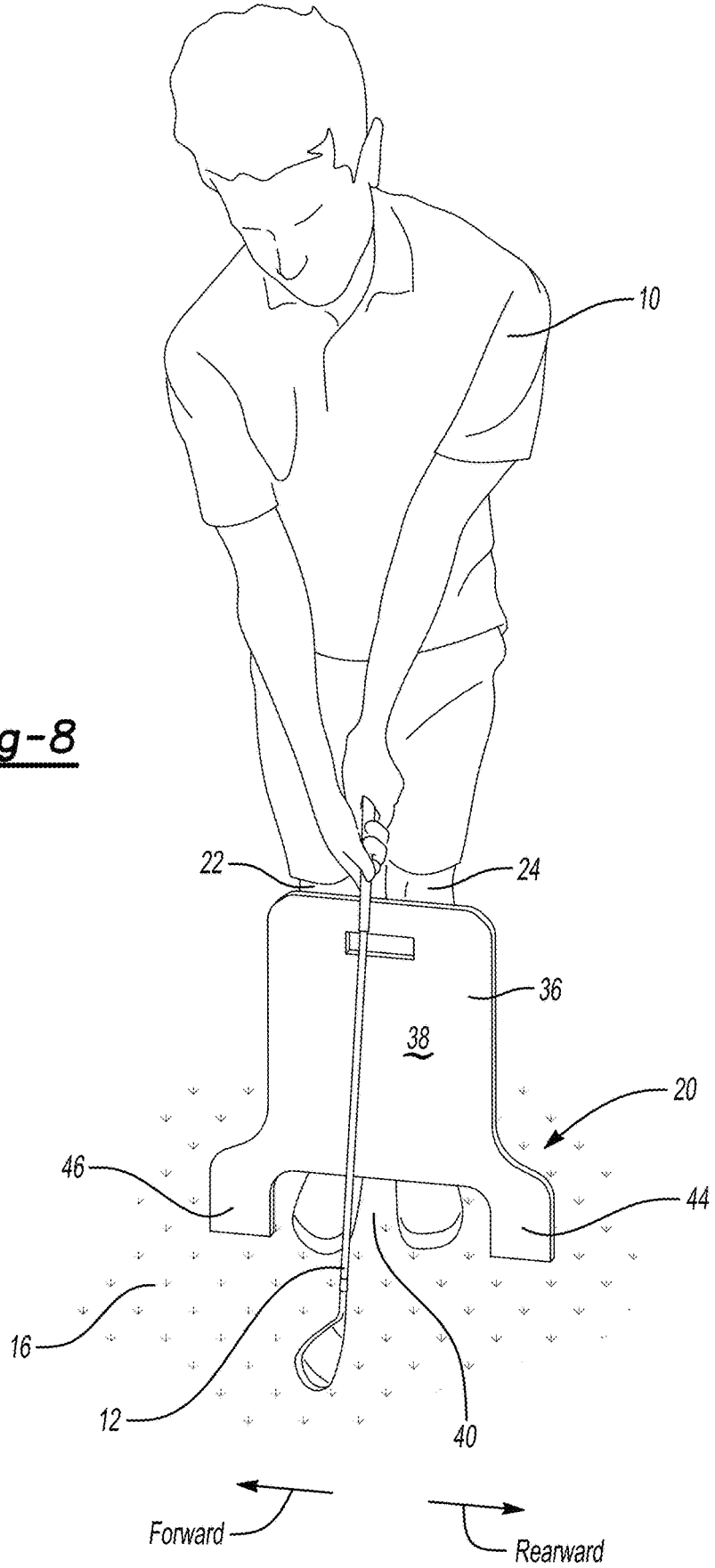
FIG. 8 is a head-on view of a golfer relative to the example knee position guide of FIG. 2.
Figure 9:
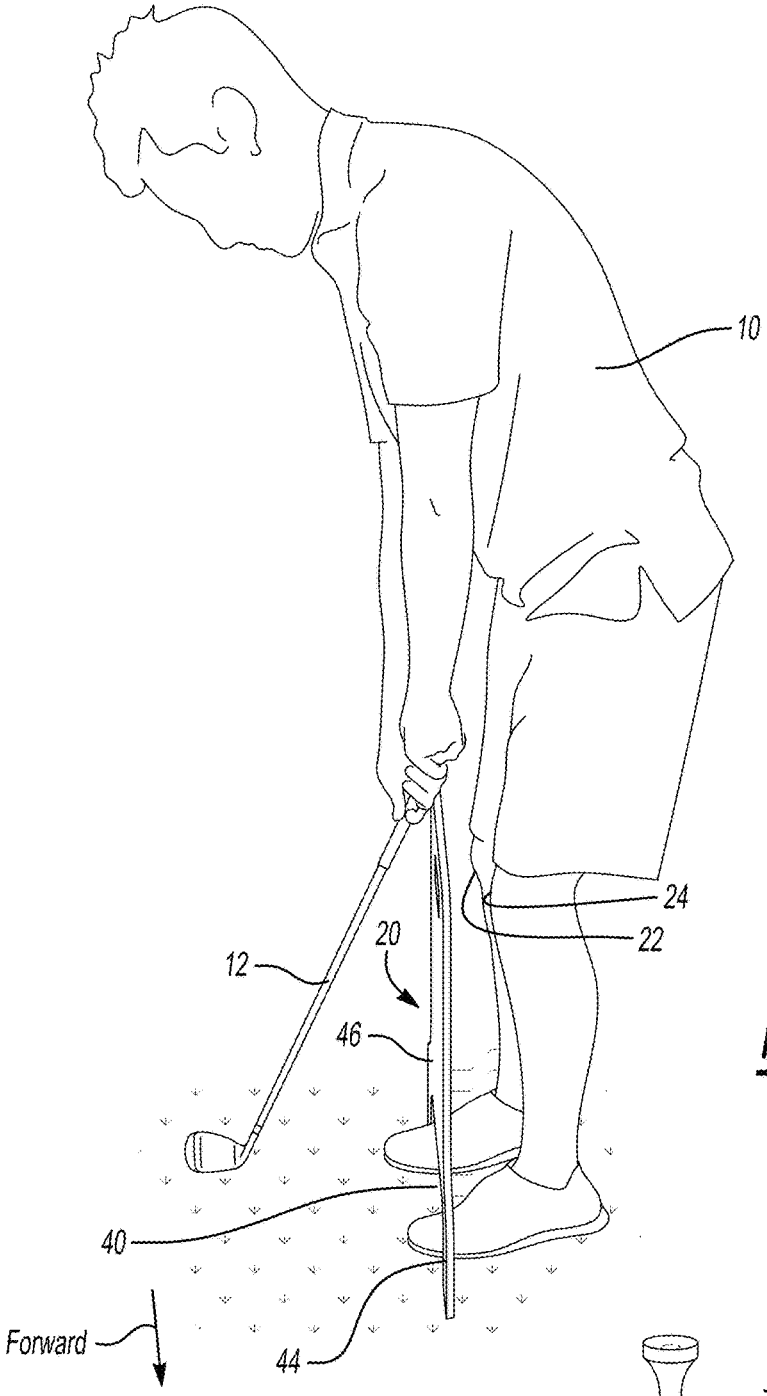
FIG. 9 is a view of a golfer relative to the example knee position guide of FIG. 2 from a forward location.

With reference back to FIG. 2, the feet 44, 46 are spaced-apart from one another in the forward and rearward direction by the toe slot 40. The toe slot 40 is an open space leading upward from a location in-line with the bottom edge 26 to the bottom of the main section 38 by a height H3, which is 4 inches in this example. The toe slot 40 has a width substantially equal to the width W1 of the main section 38. The toe slot 40 is configured such that the golfer 10 can position both of their feet, and in particular their toes, at least partially into and through the toe slot 40. The width of the toe slot 40 is such that the golfer is encouraged to keep their feet relatively close together, which is a good position for hitting short game shots. As shown in FIGS. 8 and 9, the golfer's feet are relatively close together when the golfer's toes are positioned at least partially through the toe slot 40. The toe slot 40 is bound by the ground surface 16 or the board 56 (if present) when the knee position guide 20 is in use.

With reference to FIGS. 1, 8, and 9, the toes of the right foot of the golfer 10 are positioned in the toe slot 40 adjacent the foot 46, and the toes of the left foot of the golfer 10 are positioned in the toe slot 40 adjacent the foot 44. The toes of the golfer 10 may project fully through the toe slot 40 during use of the knee position guide 20. With their toes in, or through, the toe slot 40, the golfer 10 can position their knees 22, 24 close enough to the knee position guide 20, and in particular the main section 38, such that their knees 22, 24 will contact the first side 34 of the main section 38 of the knee position guide 20 if the golfer's knees 22, 24 excessively buckle during a golf swing. Without the toe slot 40, most if not all golfers would not be able to position one or both of their knees close enough to the main section 38 for the knee position guide 20 to be effective (i.e., their knees could excessively buckle without contacting the knee position guide 20).

In an example, the golfer 10 is instructed, either by a golf instructor or a written or video tutorial, to position to support the knee position guide 20 relative the ground surface 16 such that the knee position guide 20 projects substantially 90° relative to the ground surface 16. Further, in the example, the golfer 10 is instructed to position their knees about 2 inches from the first side 34 of the main section 38 of the knee position guide 20 at set up. Specifically, the golfer 10 is instructed to position their right knee 22, relative to FIG. 1, about 2 inches from the main section 38 on the rearward side of the centerline C and to position their left knee 24 about 2 inches from the main section 38 on the forward side of the centerline C. The golfer 10 then takes a swing and, if the golfer's knees 22, 24 excessively buckle, one or both knees 22, 24 will contact the main section 38 of the knee position guide 20, providing feedback to the golfer 10 that the golfer 10 should focus on limiting such knee buckling in future swings. If the golfer's knees 22, 24 do not contact the knee position guide 20 during a swing, the golfer 10 is assured that the golfer's knees 22, 24 were properly positioned during that swing.

Figure 6:
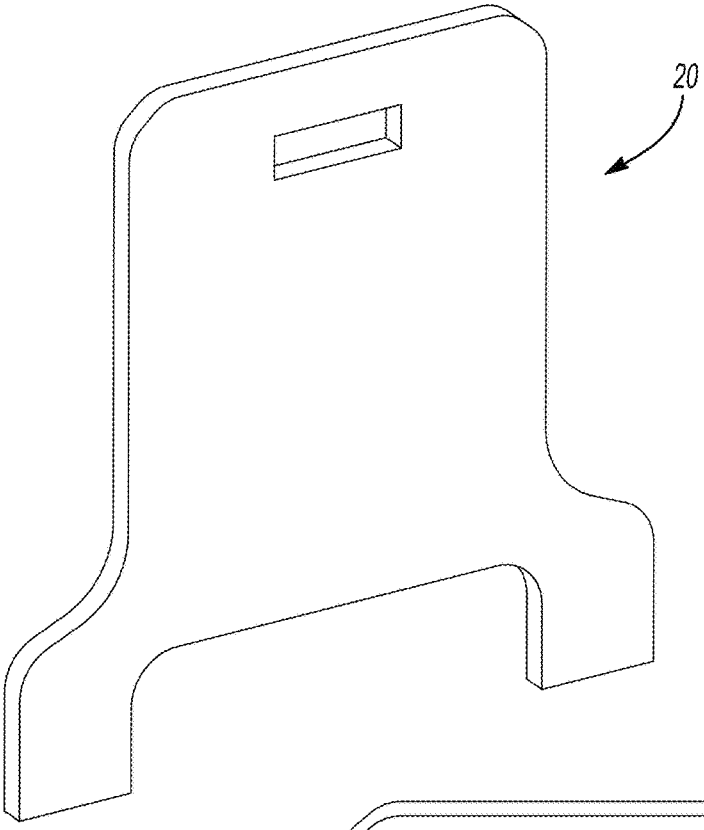
FIG. 6 is a view of still another example knee position guide.

In the example of FIG. 2, the entire knee position guide 20 is made as a single, integral structure. When stakes are present, the stakes may also be part of the single, integral structure. In this regard, the stakes can be made of wood. The wood may be coated with paint or another type of coating to protect the knee position guide 20 from the elements. Alternatively, the stakes may be formed separately from the remainder of the knee position guide 20 and attached thereto in a separate manufacturing step. In FIG. 2, the knee position guide 20 is integrally formed from a single piece of wood. In another example, such as that of FIG. 6, the knee position guide 20 is integrally formed from a single piece of plexiglass. The plexiglass may be transparent. The knee position guide 20 of FIG. 6 is substantially the same as in FIG. 2. No stakes are shown in FIG. 6, but stakes could be present, and could be formed integrally with the single piece of plexiglass or added in a separate manufacturing step. Again, in this respect, the stakes could be made of plexiglass. While wood and plexiglass are mentioned as materials for the knee position guide 20 and the stakes, other materials or combinations of materials may be used. For instance, the knee position guide 20 could be provided by fabric supported by a frame resembling the same or a similar configuration as the knee position guide 20 of FIGS. 2, 5, and/or 6.

Various corners and edges of the knee position guide 20 may be rounded or include chamfers or fillets to prevent exposure of the user to sharp edges. Further, the top edge 28 may be angled such that it is parallel or substantially parallel with an anticipated angle, known as the lie angle, of a shaft of the golf club 12 to prevent unwanted contact between the knee position guide 20 and the golf club 12 during a golf swing.

It should be understood that directional terms such as "forward," "rearward," "top," "bottom," etc., are used above consistent with their known meanings and have been used herein for purposes of explanation, and should not be considered otherwise limiting. Terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A knee position guide for use as a golf training aid, comprising:

a toe slot; and a main section arranged above the toe slot, wherein the main section is configured to contact a knee of a user if the knee excessively buckles during a golf swing, wherein the knee position guide is integrally formed from a single piece of material.

2. The knee position guide as recited in claim 1, wherein the knee position guide is configured such that when the knee position guide is in use a top edge of knee position guide extends a height within a range of 18 to 24 inches above a ground surface.

3. The knee position guide as recited in claim 1, wherein the main section extends from an uppermost edge of the knee position guide to the toe slot.

4. The knee position guide as recited in claim 1, further comprising a first foot on a first side of the toe slot, and a second foot on a second side of the toe slot opposite the first side.

5. The knee position guide as recited in claim 4, further comprising a board lying substantially perpendicular to a remainder of the knee position guide and attached to the first foot and the second foot.

6. The knee position guide as recited in claim 1, wherein the knee position guide is symmetrical about a centerline, wherein the centerline is a line extending in a direction parallel to a height of the knee position guide.

7. The knee position guide as recited in claim 1, wherein the material is plexiglass.

8. The knee position guide as recited in claim 1, wherein a top edge of the knee position guide is angled so as to be substantially parallel to an anticipated lie angle of a shaft of a golf club.

9. The knee position guide as recited in claim 1, wherein the knee excessively buckles during a golf swing if the knee moves laterally by two or more inches during the golf swing.

10. A knee position guide for use as a golf training aid, comprising:

a toe slot; and a main section arranged above the toe slot, wherein the main section is configured to contact a knee of a user if the knee excessively buckles during a golf swing, wherein the main section includes a through-hole configured to serve as a handle.

11. A knee position guide for use as a golf training aid, comprising:

a toe slot;

a main section arranged above the toe slot, wherein the main section is configured to contact a knee of a user if the knee excessively buckles during a golf swing;

a first foot on a first side of the toe slot;

a second foot on a second side of the toe slot opposite the first side;

a bracket connected to one of the first foot and the second foot and configured to support the knee position guide relative to a ground surface, and wherein (i) the bracket is detachable and/or (ii) the bracket includes an opening configured to receive a portion of an anchoring device.

12. The knee position guide as recited in claim 11, wherein the bracket is detachable.

13. The knee position guide as recited in claim 11, wherein the bracket includes an opening configured to receive a portion of an anchoring device.

14. The knee position guide as recited in claim 13, wherein the anchoring device is a golf tee.

* * * * *